US009174765B2

(12) United States Patent
Sinclair et al.

(10) Patent No.: US 9,174,765 B2
(45) Date of Patent: Nov. 3, 2015

(54) CARTON WITH PRESSURE CONTROL FEATURE

(71) Applicant: Graphic Packaging International, Inc., Atlanta, GA (US)

(72) Inventors: Mark Sinclair, Arvada, CO (US); Joseph C. Walsh, Boulder, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 122 days.

(21) Appl. No.: 14/035,539

(22) Filed: Sep. 24, 2013

(65) Prior Publication Data

US 2014/0021204 A1 Jan. 23, 2014

Related U.S. Application Data

(63) Continuation of application No. PCT/US2012/031094, filed on Mar. 29, 2012.

(60) Provisional application No. 61/516,170, filed on Mar. 30, 2011.

(51) Int. Cl.

| | |
|---|---|
| ***B65D 5/56*** | (2006.01) |
| ***B65D 51/16*** | (2006.01) |
| ***B65D 5/74*** | (2006.01) |
| ***B65D 5/70*** | (2006.01) |
| ***B65D 5/42*** | (2006.01) |
| ***B65D 5/60*** | (2006.01) |
| ***B31B 1/62*** | (2006.01) |

(Continued)

(52) U.S. Cl.

CPC . *B65D 5/563* (2013.01); *B31B 1/62* (2013.01); *B31B 1/76* (2013.01); *B31B 1/84* (2013.01); *B65D 5/4295* (2013.01); *B65D 5/606* (2013.01); *B65D 5/701* (2013.01); *B65D 5/705* (2013.01); *B65D 5/746* (2013.01); *B65D 51/1644* (2013.01); *B65D 2205/02* (2013.01)

(58) Field of Classification Search

CPC .... B65D 5/563; B65D 51/1644; B65D 5/705; B65D 5/606; B65D 5/701; B65D 5/746; B65D 5/4295; B65D 2205/02

See application file for complete search history.

(56) References Cited

U.S. PATENT DOCUMENTS

| | | | |
|---|---|---|---|
| 4,268,738 | A | 5/1981 | Flautt, Jr. et al. |
| 4,360,107 | A | 11/1982 | Roccaforte |
| 4,592,914 | A | 6/1986 | Kuchenbecker |

(Continued)

FOREIGN PATENT DOCUMENTS

| | | | |
|---|---|---|---|
| DE | 10 2008 007 384 | A1 | 8/2009 |
| GB | 1 281 067 | A | 7/1972 |

(Continued)

OTHER PUBLICATIONS

Supplementary European Search Report for EP 12 76 4321 dated Aug. 8, 2014.

(Continued)

*Primary Examiner* — Gary Elkins

(74) *Attorney, Agent, or Firm* — Womble Carlyle Sandridge & Rice, LLP

(57) ABSTRACT

A carton may include a linter. The liner may include one or more pressure control features for automatically relieving pressure from within an area enclosed by the liner. A pressure control feature may be in the form of one or more vent passageways extending through the liner.

48 Claims, 16 Drawing Sheets

(51) Int. Cl.
*B31B 1/76* (2006.01)
*B31B 1/84* (2006.01)

(56) References Cited

U.S. PATENT DOCUMENTS

| | | | | |
|---|---|---|---|---|
| 5,617,711 | A * | 4/1997 | Rodriguez et al. | 53/475 |
| 5,919,504 | A * | 7/1999 | Muise et al. | 426/106 |
| 6,213,388 | B1 | 4/2001 | Ours et al. | |
| 6,254,908 | B1 * | 7/2001 | Winters | 426/118 |
| 6,261,615 | B1 | 7/2001 | Sumpmann | |
| 7,543,708 | B2 * | 6/2009 | Doyle et al. | 206/524.8 |
| 8,087,827 | B2 * | 1/2012 | Mir | 383/102 |
| 2004/0000336 | A1 * | 1/2004 | Goglio | 137/247.15 |
| 2005/0255200 | A1 * | 11/2005 | Takahagi et al. | 426/113 |
| 2007/0087096 | A1 | 4/2007 | Mir | |
| 2007/0275136 | A1 * | 11/2007 | Hopkins | 426/234 |
| 2008/0116252 | A1 | 5/2008 | Chou | |
| 2010/0282828 | A1 | 11/2010 | Burke | |
| 2011/0095075 | A1 * | 4/2011 | Pinkstone | 229/117.27 |
| 2012/0261278 | A1 * | 10/2012 | Mandzsu et al. | 206/213.1 |

FOREIGN PATENT DOCUMENTS

| | | |
|---|---|---|
| WO | WO 97/11885 A1 | 4/1997 |
| WO | WO 2012/103161 | 8/2012 |

OTHER PUBLICATIONS

International Search Report for corresponding International Application No. PCT/US2012/031094 mailed Oct. 4, 2012.
Written Opinion of the International Searching Authority for corresponding International Application No. PCT/US212/031094 mailed Oct. 4, 2012.

* cited by examiner

CARTON WITH PRESSURE CONTROL FEATURE

CROSS-REFERENCE TO RELATED APPLICATION

This application is a continuation of International Application No. PCT/US2012/031094, which was filed Mar. 29, 2012, which claims the benefit of U.S. Provisional Patent Application No. 61/516,170, which was filed on Mar. 30, 2011.

INCORPORATION BY REFERENCE

The entire disclosure of each of International Application No. PCT/US2012/031094, which was filed Mar. 29, 2012, U.S. Provisional Patent Application No. 61/516,170, which was filed on Mar. 30, 2011, International Application No. PCT/US2012/022458, which was filed Jan. 25, 2012, and U.S. patent application Ser. No. 12/775,758, which was filed on May 7, 2010 and published as U.S. Patent Application Publication No. 2010/0282828 on Nov. 11, 2010, is incorporated herein by reference.

BACKGROUND

The present disclosure generally relates to packages or cartons for holding and dispensing products, such as food products.

If the liner of a carton is hermetically sealed at a relatively lower elevation, the enclosure formed by the liner may expand and rupture, and thereby fail to provide desired barrier properties, if the carton is shipped to a relatively higher elevation.

SUMMARY

In general, one aspect of this disclosure is generally directed to a carton for holding a product. The carton may comprise a plurality of panels at least partially enclosing an interior of the carton, and a liner that may optionally be at least partially attached to an interior surface of one or more of the panels. The liner, carton and/or associated adhesive material may comprise one or more pressure control features for helping to relieve gas (e.g. air) pressure from within an area enclosed by the liner. In one aspect of this disclosure, the pressure control features may configured for (e.g., may be characterized as being means for) automatically in a predetermined manner relieving gas pressure from within an area enclosed by the liner.

One aspect of this disclosure is the provision of a package for containing and dispensing contents, wherein the package comprises a lined carton, the liner comprises at least one vent passageway extending through the liner, and the vent passageway is configured for automatically in a predetermined manner relieving gas pressure from within an area enclosed by the liner. The liner is typically mounted to the carton and forms a substantially closed inner container that is positioned in an interior of the carton, with the vent passageway extending through a wall of the container. In one embodiment, the inner container is substantially closed in that the only openings between the interior and the exterior of the inner container are by way of the one or more vent passageways, which are for allowing only a small amount of air flow therethrough, for at least partially relieving any pressure differential between the interior and the exterior of the inner container.

One aspect of this disclosure is the provision of a carton blank comprising a plurality of panels respectively foldably connected to one another, and a liner that may be mounted at least one panel of the plurality of panels, wherein the liner comprises at least one vent passageway, and the vent passageway is configured for automatically in a predetermined manner relieving gas pressure from within an area enclosed by the liner when the carton blank and liner are together formed into the package. The carton may be erected so that the liner forms a substantially closed inner container that is positioned in an interior of the carton.

In one aspect of this disclosure, adhesive material for connecting portions of the carton and/or liner to one another is configured so as not to obstruct the vent passageway(s) extending through the liner, and the adhesive material may further be configured to at least partially define one or more vent chambers and/or vent passageways for being in communication with the vent passageway(s) extending through the liner.

The foregoing presents a simplified summary of some aspects of this disclosure in order to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which illustrate exemplary embodiments of this disclosure, are not necessarily drawn to scale and may be schematic, and wherein.

DETAILED DESCRIPTION OF EXEMPLARY EMBODIMENTS

Referring now in greater detail to the drawings, in which like numerals may refer to like parts throughout the several views, exemplary embodiments are described in the following. Cartons or packages according to the present disclosure can accommodate articles of numerous different shapes. For the purpose of illustration and not for the purpose of limiting the scope of the disclosure, the following detailed description describes articles as being at least partially disposed within the cartons. In one embodiment, the articles held in the carton can be food products, but the articles could be nonfood products. In this Detailed Description section of this disclosure, the terms "lower," "bottom," "upper", "top", "front", and "back" indicate orientations determined in relation to fully erected cartons.

Figure 1:
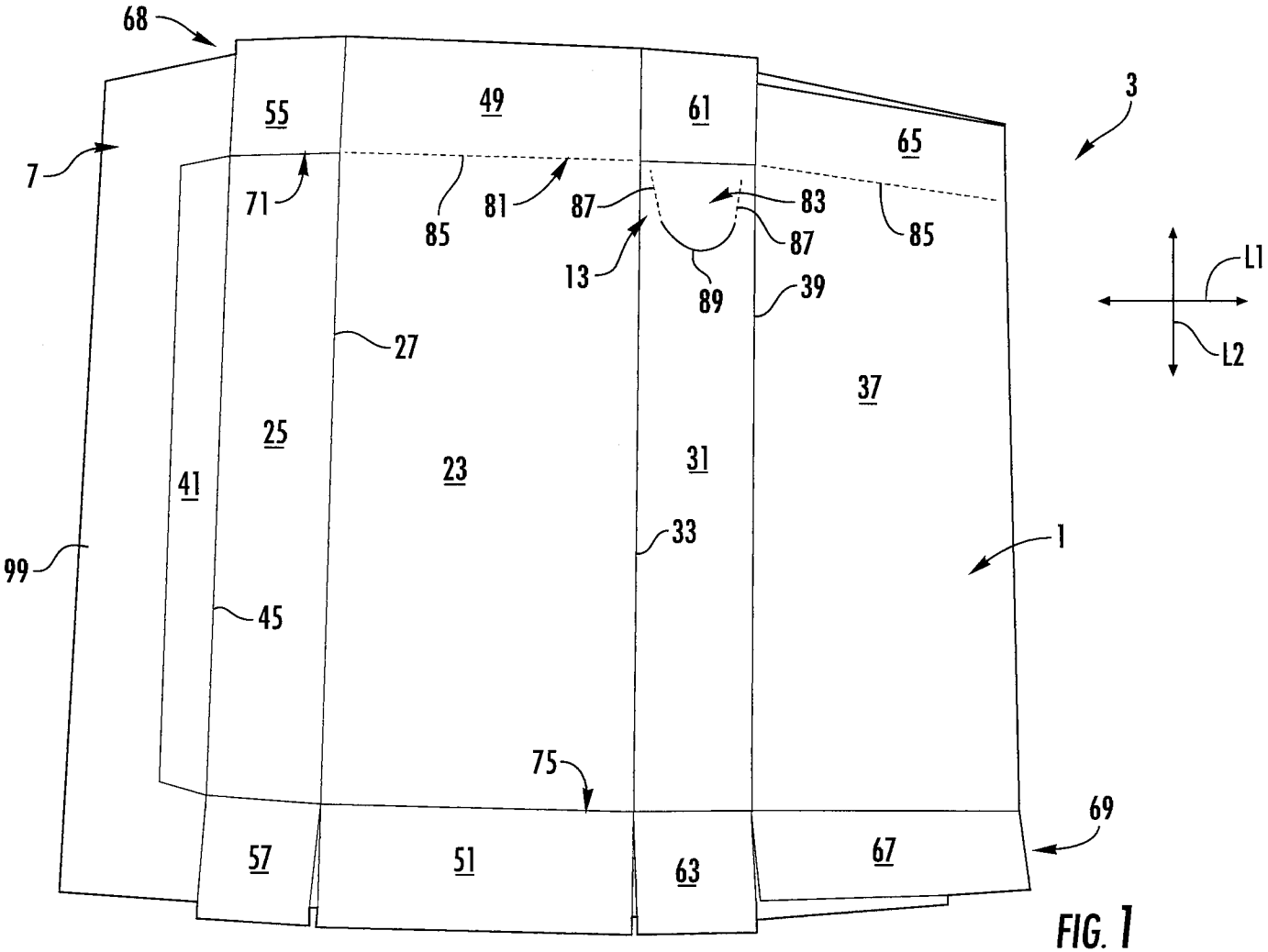
FIG. 1 is an exterior plan view of an unerected carton blank and liner used to form a carton in accordance with a first embodiment of the disclosure.

FIG. 1 is a plan view of an exterior surface 1 of a carton blank 3 used to form a carton 5 (FIG. 7) of a first embodiment of this disclosure. The carton 5 includes a liner 7 that is in contact with an interior surface 9 (FIG. 2) of the blank 3. The carton 5 can be configured to hold articles (not shown) such as a plurality of food products (e.g., candy, crackers, popcorn, breakfast cereal, or any other suitable food product), nonfood products (grass seed, fertilizer, detergent, or any other suitable nonfood product), or any other suitable article or product within an interior 11 (FIGS. 5 and 6) of the carton. The liner 7 can help maintain freshness and quality of the products enclosed by the liner, by enhancing the barrier protection provided by the carton 5. In one embodiment, the liner 7 can be hermetically sealed, or nearly hermetically sealed, around the interior 11 except for one or more pressure control features 15 (FIG. 3) as described below. The carton 5 can include a dispenser feature 13 extending in both the blank 3 and the liner 7. According to the first embodiment, the pressure control feature 15 can be incorporated into the dispenser feature 13 of the liner 7 or in any other suitable location in the liner 7. The carton 5 can include various differently configured dispensing features and various handle features without departing from the scope of this disclosure.

Referring to FIG. 1, the blank 3 has a longitudinal axis L1 extending generally in the direction of the length of the blank and a lateral axis L2 extending generally in the direction of the width of the blank. The blank 3 includes a front panel 23 foldably connected to a first side panel 25 at a lateral fold line 27. A second side panel 31 is foldably connected to the front panel 23 at a lateral fold line 33. A back panel 37 is foldably connected to second side panel 31 at a lateral fold line 39. An attachment flap 41 is foldably connected to the first side panel 25 at a lateral fold line 45. Alternatively, the attachment flap 41 could be foldably connected to the back panel 37.

In the illustrated embodiment, there are two end flaps 49, 51 foldably connected to opposite ends of the front panel 23, two end flaps 55, 57 foldably connected to opposite ends of the first side panel 25, two end flaps 61, 63 foldably connected to opposite ends of the second side panel 31, and two end flaps 65, 67 foldably connected to opposite ends of the back panel 31. When the carton 5 is erected and closed, the end flaps 49, 55, 61, 65 close a first (e.g., top) end 68 (FIG. 7) of the carton, and the end flaps 51, 57, 63, 67 close a second (e.g., bottom) end 69 (FIG. 7) of the carton. In accordance with an alternative embodiment, different panel and flap arrangements can be used for forming and closing the carton 5.

The end flaps 49, 55, 61, 65 of the first end 68 extend along a first marginal area of the blank 3, and are foldably connected at a first longitudinal fold line 71 that extends along the length of the blank. The end flaps 51, 57, 63, 67 of the second end 69 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 61, 65, 51, 57, 63, 67 can be alternatively shaped, arranged, positioned, foldably connected and/or omitted without departing from the scope of this disclosure.

Figure 2:
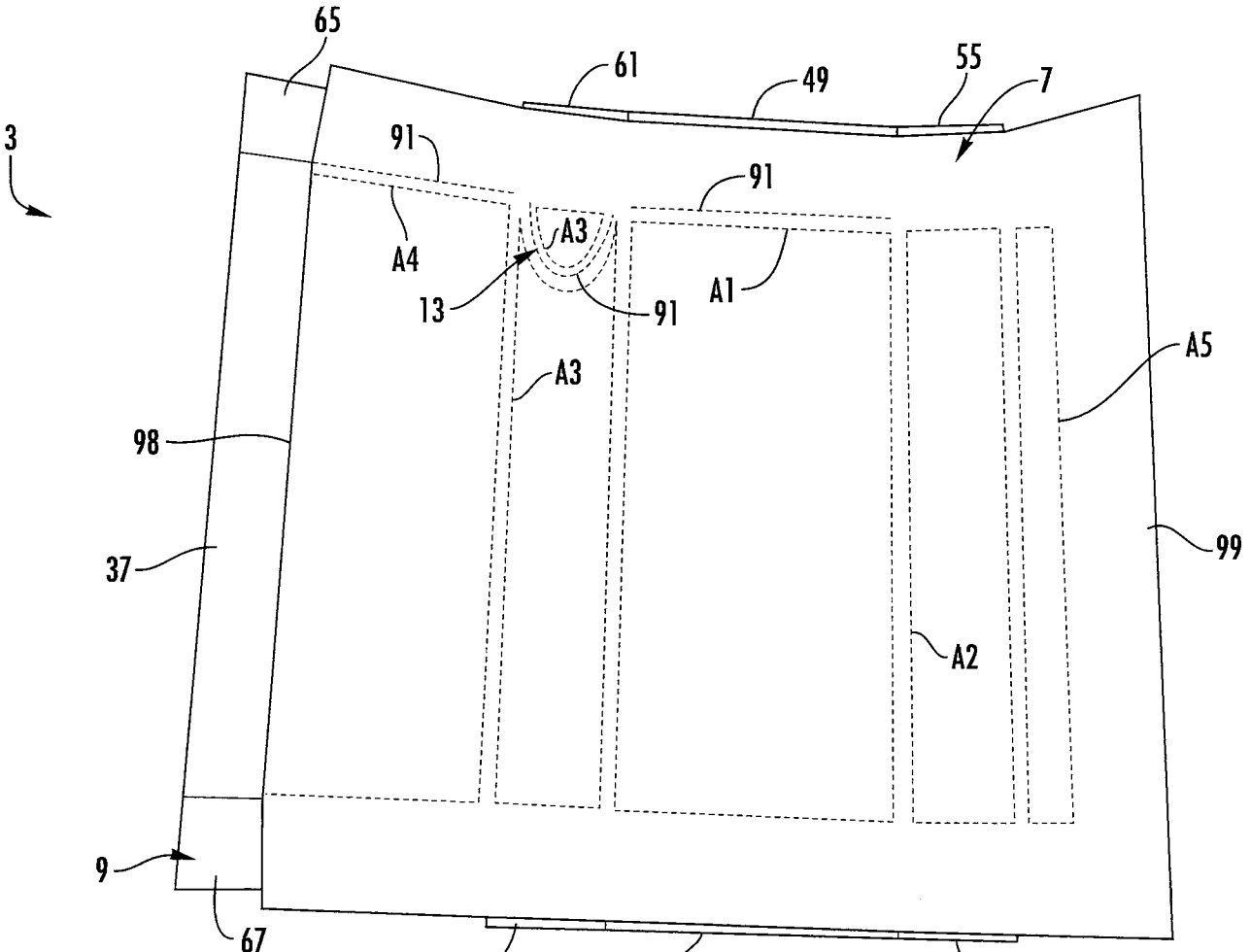
FIG. 2 is a schematic interior plan view of the unerected blank and liner of FIG. 1.

As shown in FIG. 2, the liner 7 overlays the interior surface 9 of the blank 3. The liner 7 can comprise one or more layers or plies 77, 79 (FIG. 3) and can be composed of any suitable material that is relatively flexible and relatively fluid impervious. In the embodiment illustrated in FIG. 3, which schematically shows an exemplary cross-sectional view of a portion of the liner 7, the liner includes an outer paper ply 77 and an inner polymer ply 79. The polymer ply 79 may be a polymer coating or film that may be laminated to, or otherwise fixedly attached to, the paper ply 77. For example and in accordance with the first embodiment, the liner is a laminate that comprises, or consist essentially of, the paper and polymer plies 77, 79, although other configurations are within the scope of this disclosure. The paper ply 77 can comprise 25-lb kraft paper, for example. Alternatively, the paper ply 77 can be constructed of paper of a type that is within a range of approximately 20-lb paper to approximately 60-lb paper, or the ply 77 may be constructed of any other suitable material for forming a portion of the liner 7. The polymer ply 79 can comprise polyethylene, polypropylene, polyethylene terephthalate, polystyrene, polyvinyl chloride, or any other suitable material. In addition, the liner 7 can include additional plies or layers, such as a foil layer or ply, multiple paper layers or plies, and multiple polymer layers or plies. For example, an optional metallization layer or ply can be deposited on the inner or outer surface of the liner 7 to further increase the barrier properties of the liner 7. The metallization layer or ply may be provided on a surface of the liner 7 by vapor deposition and can be an aluminum layer or ply. The liner 7 having only one paper ply 77 and one polymer ply 79 is shown by way of example and for clarity. In use, a liner can have any suitable number of paper, foil, and/or polymer layers or plies in any suitable combination (e.g., one polymer layer or ply, or a foil layer or ply between two polymer layers or plies, or a polymer layer or ply on a foil layer or ply on a second polymer layer or ply on a paper layer or ply, etc). In an alternative embodiment, the liner 7 could included only fluid pervious material(s) without departing from the scope of this disclosure.

Referring to FIG. 1, the dispenser feature 13 can include a dispenser pattern 81 in the blank 3, with the dispenser pattern defining a dispenser section 83 comprising the end flaps 49, 61, 65 and an upper portion of the second side panel 31. The dispenser pattern 81 can include tear lines 85, which are generally collinear with the first longitudinal fold line 71 where the end flaps 49, 65 are connected to the respective front panel 23 and back panel 37, and tear lines 87 extending from proximate the longitudinal fold line 71 in the second side panel 31 to a curved cut line 89. The dispenser pattern 81 can further, or alternatively, include differently configured tear lines and/or cut lines, such as in the upper portion of the first side panel 25.

Figure 3:
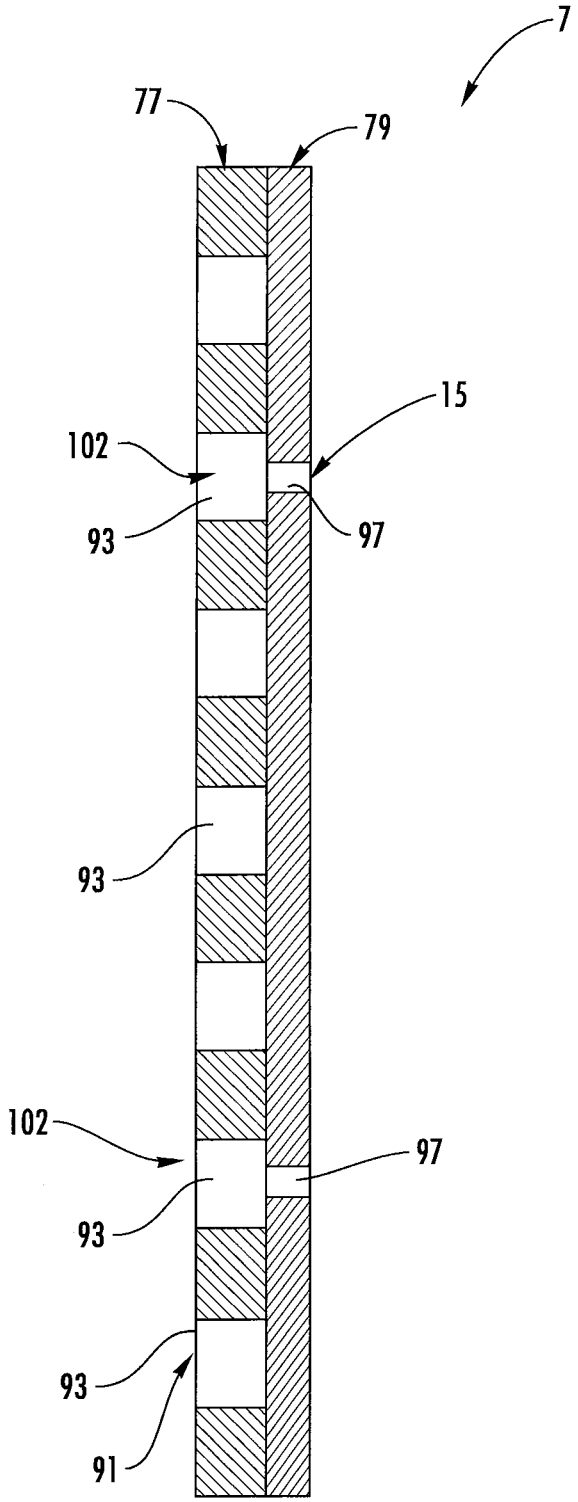
FIG. 3 is an isolated, schematic cross-sectional view of a portion of the liner according to the first embodiment.

As shown in FIGS. 2 and 3, the dispenser features 13 can further include weakened areas, such as a tear line 91 (e.g., tear lines), formed in the liner 7. The weakened areas (e.g., tear line 91) may be formed by removing at least a portion of one or more layers or plies of the liner. For example, a software-driven laser cutting system can be used to remove the paper ply 77 (FIG. 3) in a series of holes 93 (e.g., kiss cuts, shallow slits, or the like). Alternatively, the tear line 91 can be formed mechanically, such as with a rule die cutting tool, heat stamping, or other suitable method. The tear line 91 can generally overlap (e.g., be collinear with), or be slightly offset from, the tear lines 85, 87 and the cut line 89 in the blank 3 when the liner is attached to the blank.

The dispenser feature 13 can be opened after the carton 5 is formed by pushing the dispenser section 83 inwardly at the upper portion of the second side panel 31 to separate the dispenser section from the second side panel 31 at the tear lines 87 and to tear the liner 7 along the tear line 91, and pulling the dispenser section upwardly to separate the dispenser section from the front and back panels 23, 37 at the tear lines 85. The pivoting of the dispenser section 83 also continues to tear the liner 7 along the tear line 91 to provide access to the articles/products within the interior 11 of the carton 5. The dispenser feature 13 can be alternatively shaped, arranged, positioned, and/or omitted without departing from the disclosure.

As shown in FIG. 3, the pressure control feature 15 can be formed in the liner 7 at the tear line 91 or other weakened areas. The features of the liner 7 are exaggerated and not drawn to scale in FIG. 3 for clarity. FIG. 3 shows a schematic cross-section of the liner at (i.e., along) a portion of the tear line 91. In the exemplary embodiment of FIG. 3, the holes 93 extend in (e.g., all the way through) the paper ply 77 of the liner to form the tear line 91. Alternatively, the holes 93 can extend partially through the paper ply 77 or into the polymer ply 79. The pressure control feature 15 includes one or more apertures 97 (e.g., holes) in the polymer ply 79 that are each generally aligned with a hole 93 to form a vent passageway 102 that extends entirely through the liner 7. The apertures 97 can be formed at the same time as the tear line 91. For example, a laser cutting system can be programmed to form kiss cuts for the tear line 91 with portions of two of the kiss cuts extending entirely through the liner 7 to form the apertures 97 such that those two kiss cuts are complete cuts, or vent passageways 102, rather than kiss cuts. Alternatively, the apertures 97 can be formed by any suitable means, such as by a mechanical cutting tool, and there may be any suitable number of apertures 97 and/or vent passageways 102. In the first embodiment, the vent passageways 102 extend substantially perpendicularly through the liner 7, so that the vent passageways 102 ultimately extend substantially perpendicularly through a wall of the inner container that the liner 7 is formed into.

In the exemplary embodiments of this disclosure, the apertures 97 may be small enough in size and number so that they are operative to maintain freshness and quality of the products enclosed by the liner 7 for an extended period of time, preferably (optionally) such as several weeks or months. The size and number of the apertures 97 may be based on a variety of factors, such as the conditions to which the carton 5 may be exposed, the contents of the carton, and the amount of time that may pass before the carton/closed liner 7 will be opened. For example, the apertures 97 can be in the range of about 0.003 inch to about 0.015 inch in diameter. That is, the apertures 97 may be less than about 0.015 inch in diameter. For example, in one exemplary embodiment the apertures 97 can each be approximately 0.004 inch in diameter. As shown in FIG. 3, the pressure control feature 15 can include two apertures 97, which can be spaced apart and located anywhere along the tear line 91. Alternatively, the apertures 97 can be any suitable size, and the pressure control feature 15 can include any suitable number of apertures 97 to allow air in the interior 11 of the carton 5 to escape the liner 7 when the pressure in the liner is greater than the ambient pressure outside the carton 5 to thereby help reduce stress on the liner 7. For example, a particularly large carton 5 could include three or four apertures 97 as needed, or the two apertures 97 could be larger in diameter (e.g., about 0.008 inch). Each of the diameters may be perpendicular to the thickness of the polymer ply 79. In the first embodiment, for each of the vent passageways 102, the hole 93 and aperture 97 thereof are in fluid communication with one another; and the aperture is smaller than the hole, although other relative sizes are within the scope of this disclosure. As shown in FIG. 3, the spacing between adjacent apertures 97 of the series of apertures 97 (e.g., holes) is greater than spacing between adjacent holes 93 of the series of holes 93, and the series of apertures 97 is collinear with the series of holes 93, although other relative relationships are within the scope of this disclosure.

As shown in FIGS. 2 and 4-7, and described in the following in accordance with one acceptable example, the carton 5 is formed from the blank 3 by first overlaying the interior surface 9 of the blank with the liner 7. The liner 7 can be selectively attached to the blank 3 by adhesive, such as glue, or other attachment methods such as heat sealing, ultrasonic welding, etc. In the illustrated embodiment, the liner is glued to the front and back panels 23, 37 and the side panels 25, 31, and the portions of the liner 7 overlapping the lateral fold lines 27, 33, 39, 45, the longitudinal fold lines 71, 75, and the end flaps 49, 55, 61, 65, 51, 57, 63, 67 are not glued to the blank 3. In a particular embodiment, the portions of the panels 23, 25, 31, 37 immediately adjacent to the lateral fold lines 27, 33, 39, 45 and the longitudinal fold lines 71, 75 also can be free from glue to allow easier folding of the blank 3 along the fold lines. For example, the portions of the panels 23, 25, 31, 37 within approximately 0.125 inch of the lateral fold lines 27, 33, 39, 45 and the longitudinal fold lines 71, 75 are not glued to the liner. As shown in FIG. 2, the liner can be glued to the blank in the regions defined by the dashed lines A1-A5. Alternatively, any suitable amount of the liner 7 can be glued to the blank 3 to secure the liner to the blank without departing from the disclosure. For example, discrete strips or dots of glue can be used to secure the liner 7 to the blank 3, or substantially all of the liner 7 overlapping the blank 3 can be glued to the blank so that the liner is glued to the front, back, and side panels 23, 37, 25, 31, the end flaps 49, 55, 61, 65, 51, 57, 63, 67, and the fold lines 27, 33, 39, 45, 71, 75.

In the illustrated embodiment, the portion of the liner 7 overlapping the tear lines 87 and the cut line 89 in the second side panel 31 can be free of glue so that the adhesive does not significantly affect the operation of the tear lines 87 and the cut line 89 in the blank 3 and the tear line 91 in the liner 7, and so that the adhesive does not seal or obstruct the apertures 97 of the pressure control feature 15. The liner 7 can be alternatively attached, or not attached, to the blank 3 without departing from the disclosure.

Figure 4:
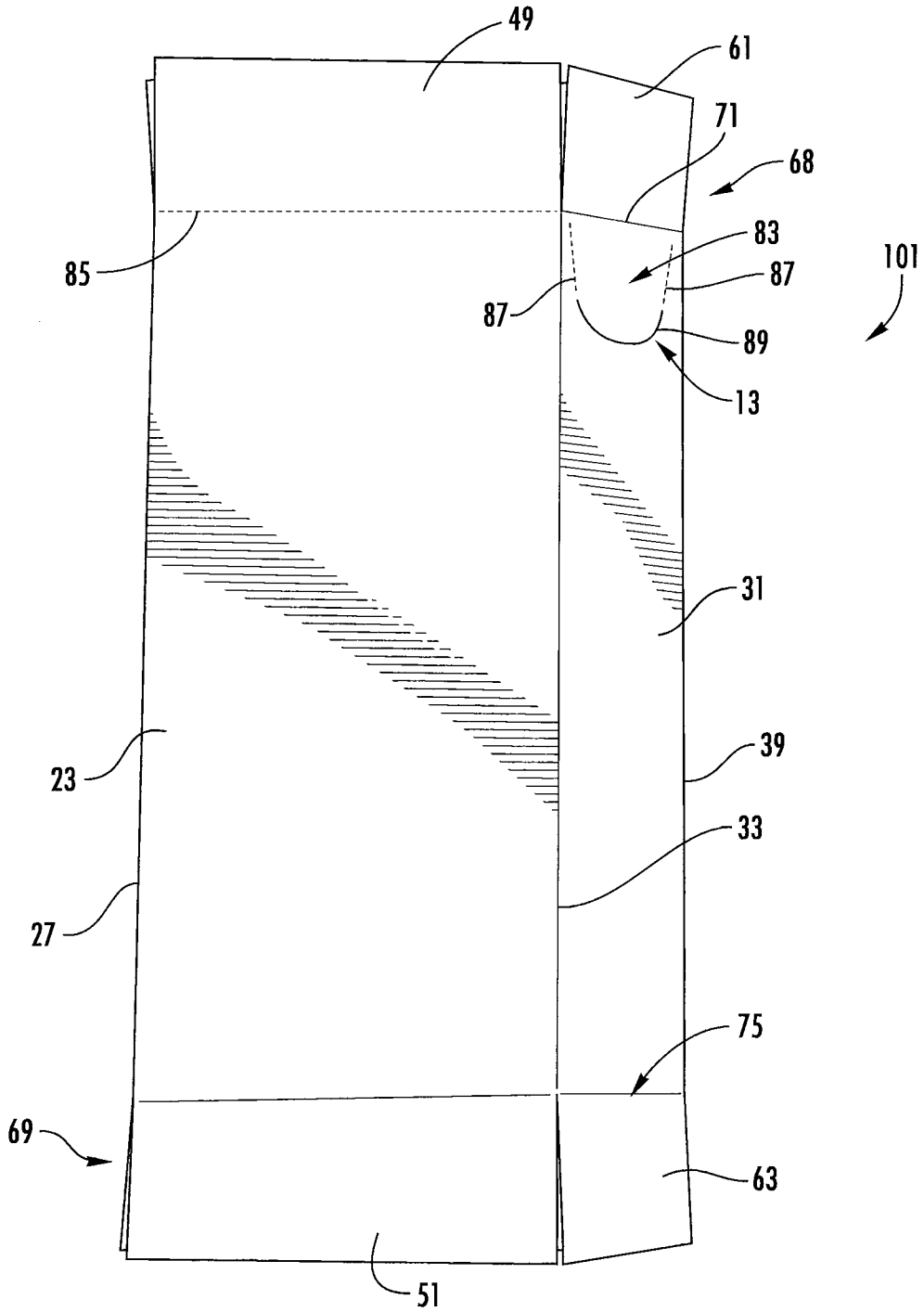
FIGS. 4-6 are perspective views showing stages of the carton being erected from the blank and liner of FIG. 1, in accordance with the first embodiment.

As shown in FIG. 2, the liner 7 can include a first lateral margin 98 and a second lateral margin 99, wherein the liner can overlap the blank 3 so that a portion of the back panel 37 and the end flaps 65, 67 adjacent the first lateral margin 98 are not overlapped by the liner prior to forming the carton. Additionally, a portion of the liner 7 including the second lateral margin 99 can extend beyond the laterally-extending edge of the attachment flap 41. As shown in FIG. 4, the blank 3 and the liner 7 can be folded along the lateral fold lines 33, 45 so that the lateral margins 98, 99 overlap one another and the back panel 37 overlaps the attachment flap 41. The lateral margins 98, 99 can be glued, or otherwise sealed or attached, together along substantially the entire lateral width of the liner 7. The attachment flap 41 can be glued, or otherwise attached, to the back panel 37, forming a sleeve 101 (FIG. 4). All of the adhesive material (e.g., glue) is typically arranged so as not to obstruct the one or more apertures 97 of the pressure control feature.

Figure 5:
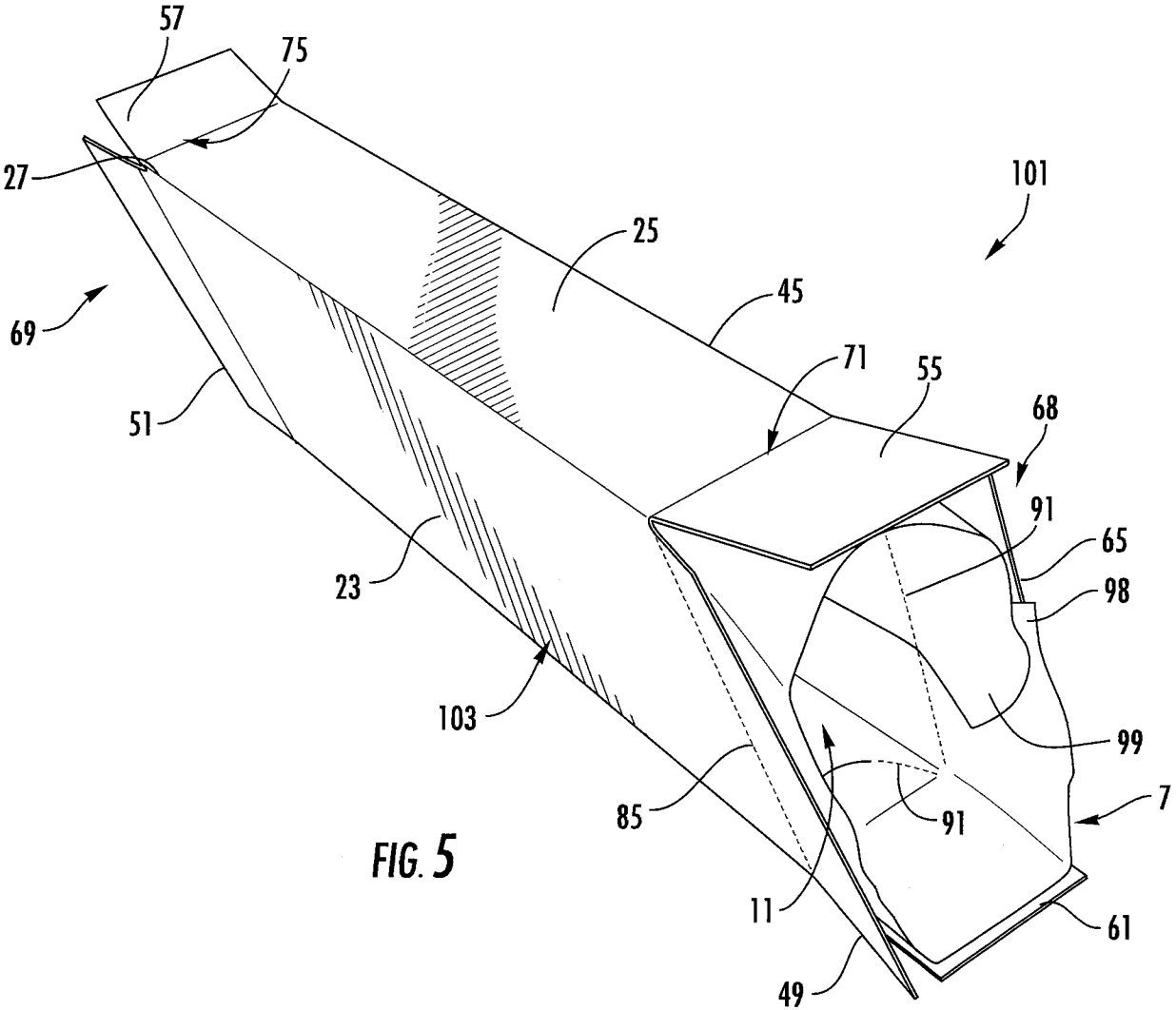
Figure 6:
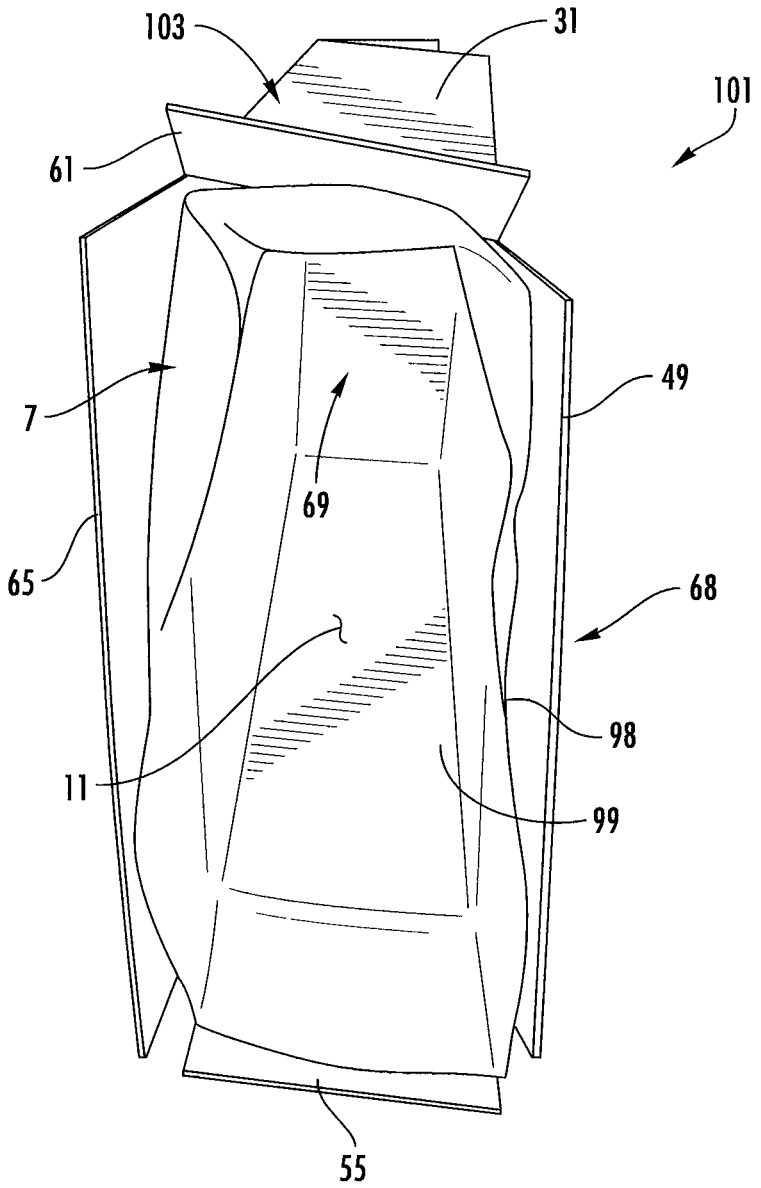

As shown in FIG. 5, the sleeve 101 can be folded along the lateral fold lines 27, 33, 39, 45 to separate the front and back panels 23, 37 so that the sleeve 101 is in a generally open-ended tubular form. The end of the liner 7 adjacent the second end 69 can be closed by overlapping the portions of the liner 7 adjacent the end flaps 51, 57, 63, 67 and gluing the overlapped portions of the liner to one another to form a substantially air-tight seal (FIG. 6). The end flaps 51, 57, 63, 67 can be respectively folded and at least partially overlapped to further close the second end 69 of the sleeve 101. Articles (e.g., food products, nonfood products, etc.) can be loaded into the partially erected carton 5, and the portions of the liner 7 adjacent the end flaps 49, 55, 61, 65 can be overlapped and glued to form a substantially air-tight seal. The ends of the liner 7 can be sealed by any suitable seal, such as a pinch seal, a fin seal, and/or a fold-over seal. The apertures 97 of the pressure control feature 15 are typically distant from, and not obstructed by, any of the seals that are formed between edges of the liner 7 for forming the liner into a bag or bag-like enclosure. In the first embodiment, the inner container formed by the liner 7 is substantially closed in that the only openings between the interior and the exterior of the inner container are by way of the vent passageways 102 (FIG. 3), which are for allowing only a small amount of air flow therethrough, for at least partially relieving any pressure differential between the interior and the exterior of the inner container. Alternatively, the ends of the liner can be closed without sealing without departing from the scope of the disclosure. The end flaps 49, 55, 61, 65 can be respectively folded and at least partially overlapped to further close the first end 68. The end flaps can be respectively glued together at the first and second ends 68, 69 to secure the closed ends. A variety of assembling, loading, and closing steps may be used without departing from the scope of the disclosure. For example, the sleeve can be loaded and closed in an automated process, and the ends 68, 69 can be partially closed. In the first embodiment, the liner 7 is mounted to the carton 103 by adhesive material and forms a substantially closed inner container that is positioned in an interior of the carton.

Figure 7:
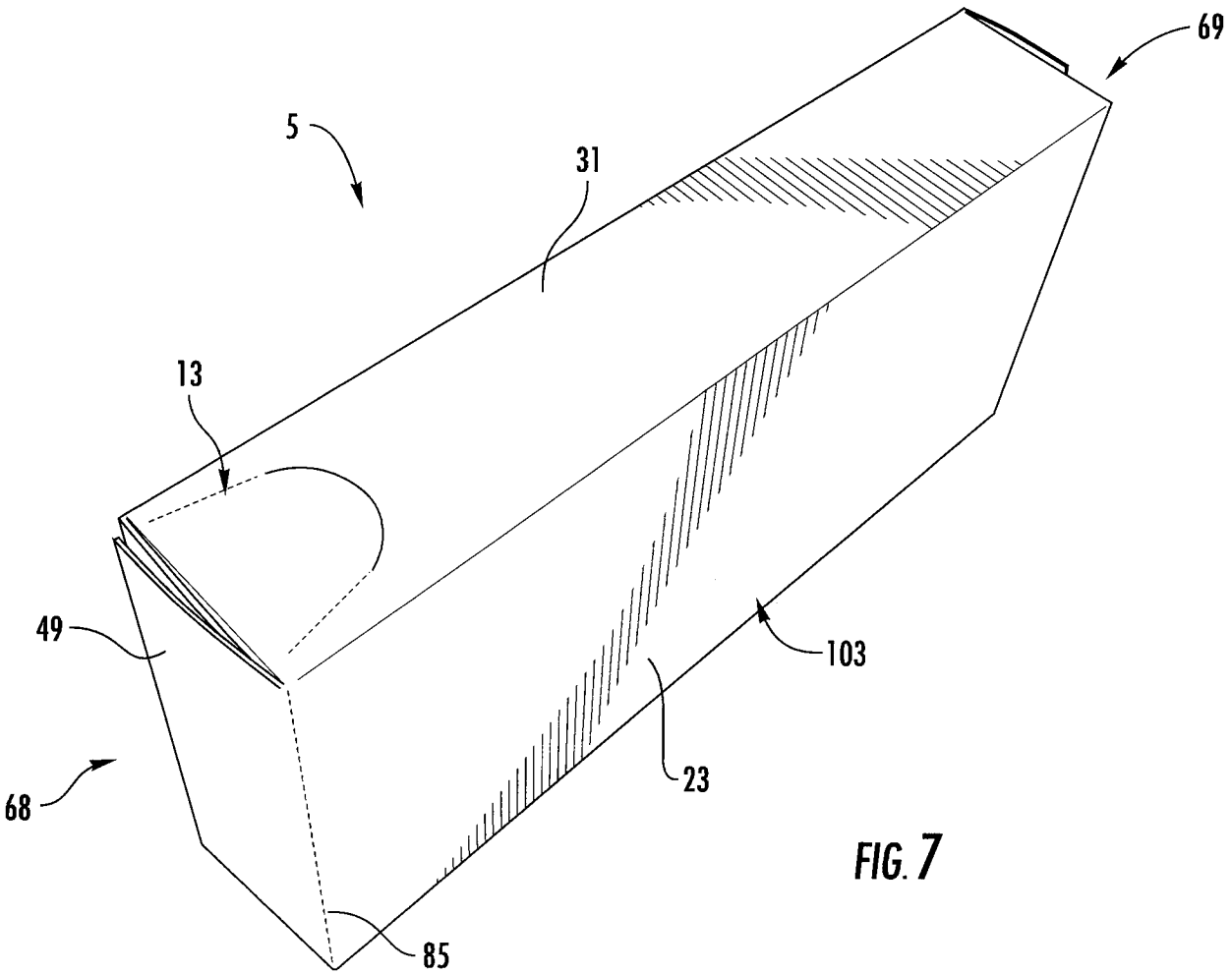
FIG. 7 is a perspective view showing the fully erected and closed carton in accordance with the first embodiment.

The erected carton 5, including the liner 7 disposed within an outer carton 103 formed from the blank 3, is shown in FIG. 7. The closed carton 5 can be shipped, stored, or otherwise handled in a variety of suitable manners. For example, the carton 5 can be erected and loaded at relatively near sea level and then shipped to or through a relatively high altitude region, or the carton 5 can be otherwise introduced to a relatively low ambient air pressure. As the ambient air pressure is reduced below the air pressure within the liner 7, the air within the liner can escape through the vent passageways 102 of the pressure control feature 15. The rate that the air is vented from the liner can depend on at least the pressure differential between the air in the liner and the ambient air pressure and the size and number of the vent passageways 102. The size and number of vent passageways 102 can be adjusted as needed to allow a sufficient venting rate to substantially prevent a high pressure differential between the interior 11 of the carton 5 and the ambient atmosphere. Accordingly, the pressure control feature 15 can help reduce the risk of a high pressure differential permanently deforming the liner, causing a failure of the seals, or otherwise rupturing or damaging the liner 7. After passing through the vent passageways 102, the air can vent through (e.g., diffuse through) the paperboard (e.g., diffuse through or between the fibers of the paperboard) of the outer carton 103 and/or through a line of disruption, such as cut line 89 and/or tear lines 85, 87, to the ambient atmosphere. In addition, or alternatively, the air can escape the outer carton 103 through the overlapped end flaps at one or both ends of the carton. Further, it may be sufficient for air to escape the liner 7 and remain in a portion of the carton 5 between the outer carton 103 and the liner 7 to reduce significant stress on the liner.

In the illustrated embodiment, the carton 5 can be opened by depressing the portion of the dispenser section 83 in the second side panel 31, separating the dispenser section from the second side panel at the cut line 89 and tearing along the tear lines 87. Accordingly, the dispenser section 83 pivots inwardly and tears the liner 7 along the tear line 91. As the pivoting portion of the dispenser section 83 pivots toward the first end 68, the dispenser section can be pulled upwardly, away from the first end 68. The end flaps 49, 65 tear away from the front and back panels 23, 31 along the tear lines 85, and the liner 7 continues to tear along the tear line 91. The dispenser section 83 can pivot about the portion of the first longitudinal fold line 71 connecting the end flap 55 to the first side panel 25. Alternatively, the dispenser section 83 can be fully removed from the first end 68. With the dispenser section 83 at least partially removed, the contents of the carton 5 can be removed, such as by pouring the contents through the opened first end 68. The carton can be opened by alternative opening steps without departing from this disclosure.

The carton 5 could include various handle features for carrying the carton and could include various alternative dispenser features for opening the carton. Further the carton 5 could include other panel/flap closing configurations without departing from the disclosure.

The carton 5 is shown and described by way of example. Alternatively, the pressure control feature 15 can be incorporated into a liner for any suitable carton style having any suitable panel configuration.

Figure 8:
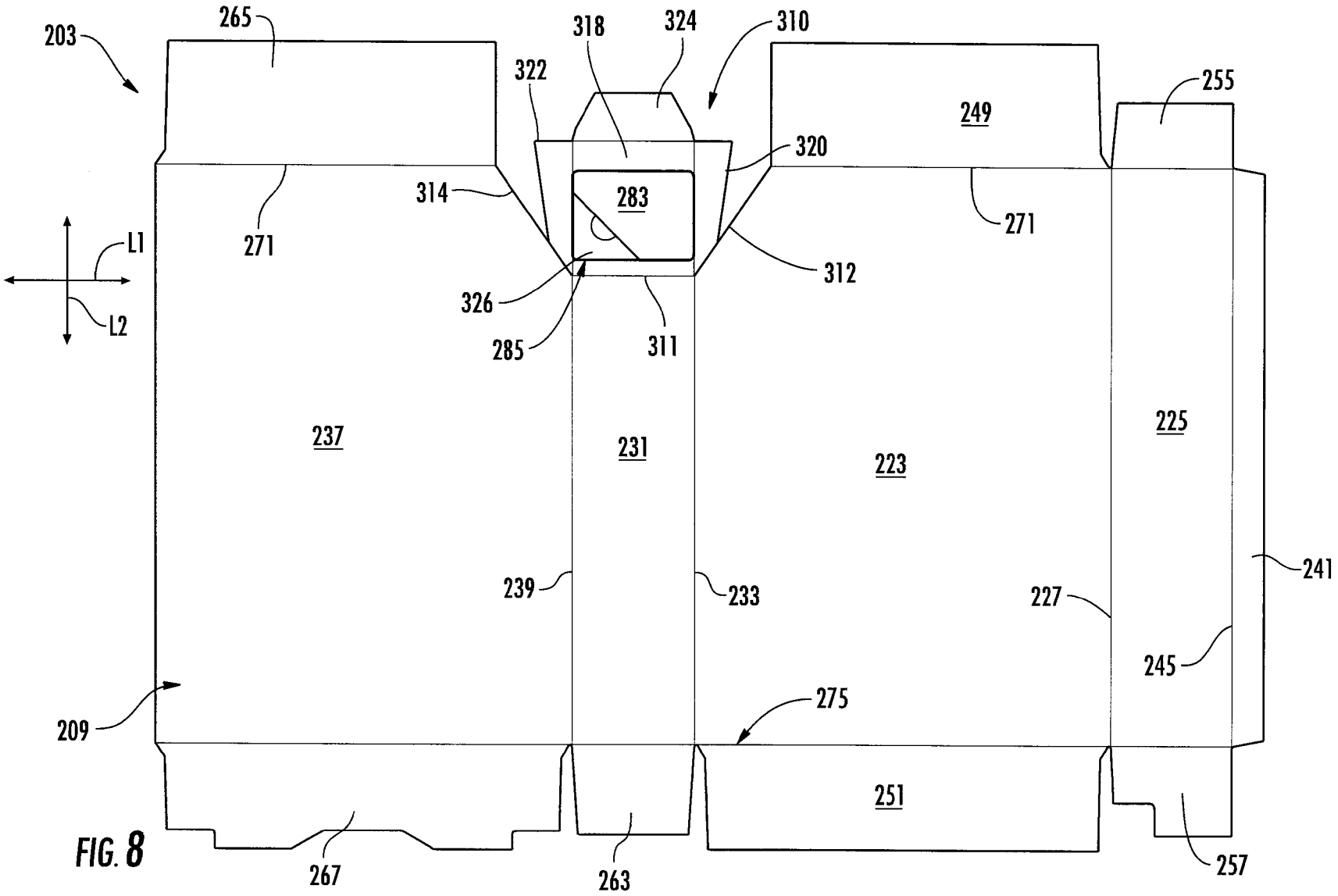
FIG. 8 is a plan view of an unerected carton blank used to form a carton in accordance with a second embodiment of this disclosure.
Figure 11:
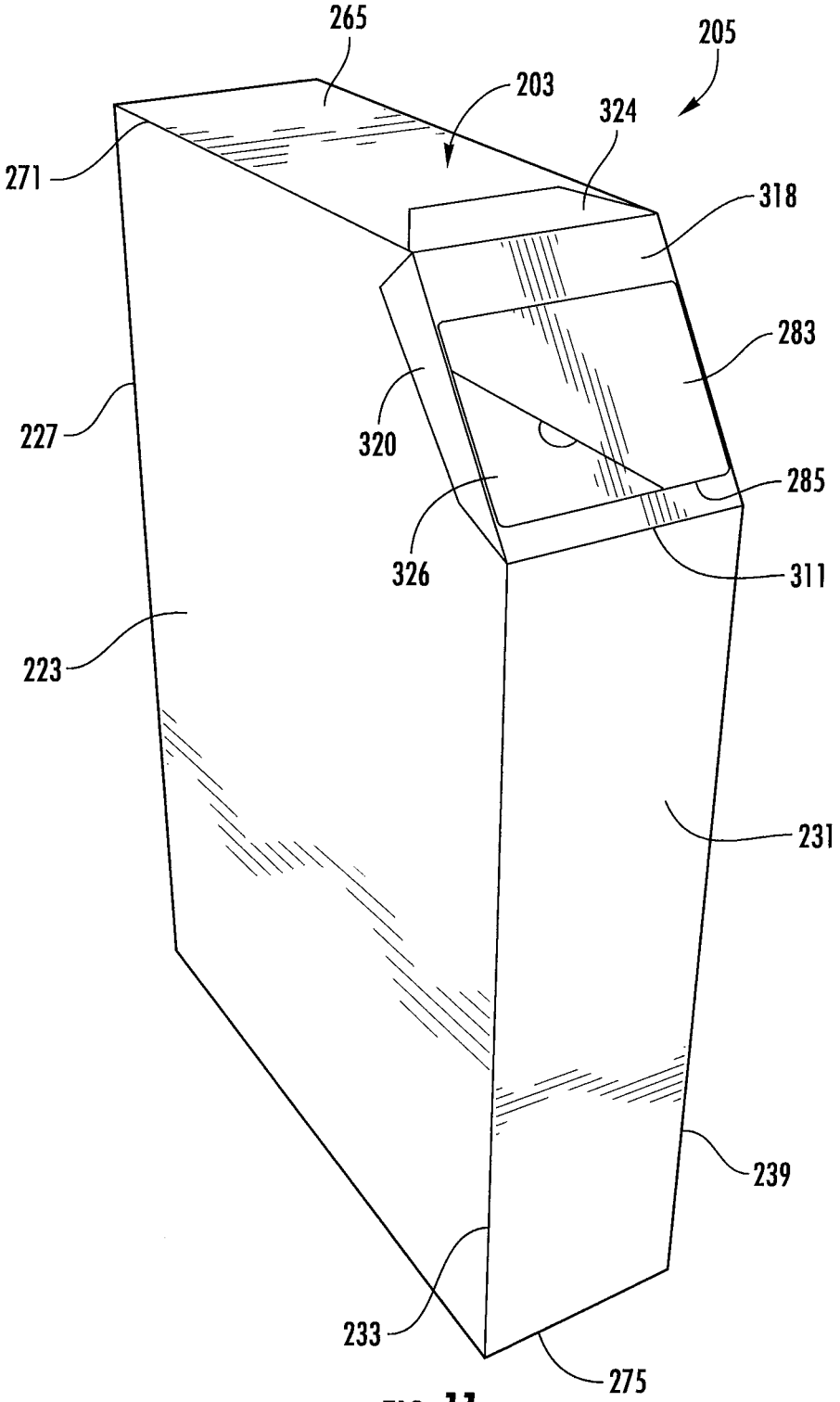
FIG. 11 is a perspective view showing the erected carton in accordance with the second embodiment.
Figure 12:
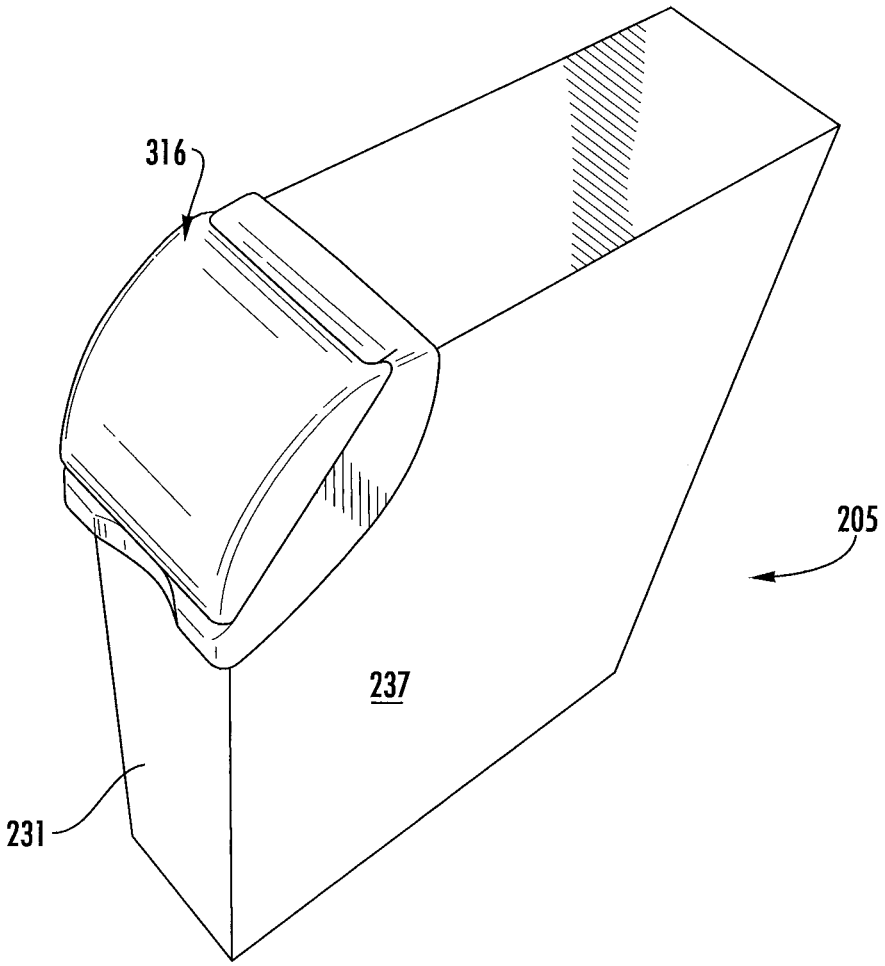
FIG. 12 is a perspective view showing the carton of FIG. 11 with an optional reclosable fitment attached thereto.
Figure 13:
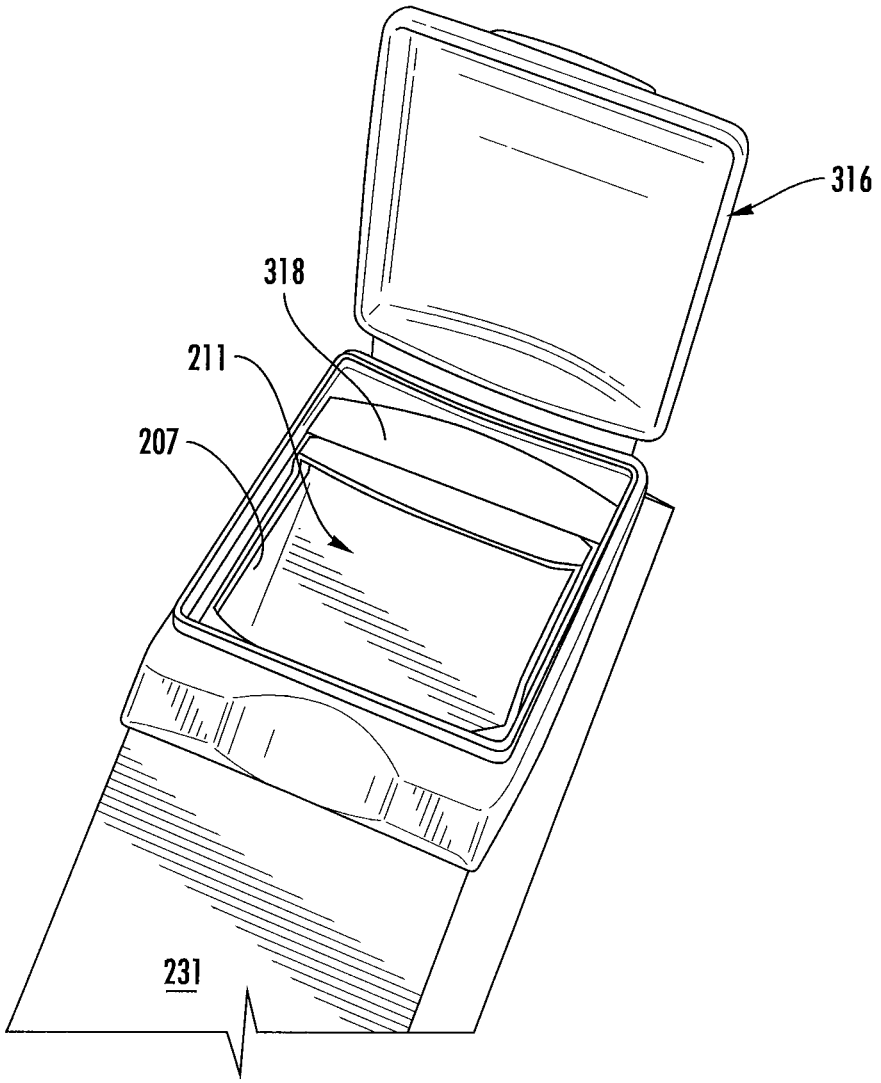
FIG. 13 is a perspective view showing the carton and fitment of FIG. 11 in opened configurations (e.g., the dispenser panel has been removed from the carton).

For example, FIG. 8 is a plan view of an interior surface 209 of a blank 203 for forming a carton 205 (FIG. 11-13) having an alternative configuration according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. Additionally, the carton of the second embodiment may be generally similar to at least one of the cartons described in co-pending International Application No. PCT/US2012/022458, which was filed Jan. 25, 2012, and has been incorporated herein by reference. As shown in FIGS. 11-13, the carton 205 includes an outer carton 303 formed from the blank 203 and an opening feature 213. A liner 207 (FIGS. 9, 10, and 13) can be attached to the outer carton 303 and enclose the interior 211 of the carton 205. The liner 207 is shown as being transparent in FIG. 9 for clarity; however, the liner can have any level of transparency or translucency, or the liner can be opaque.

The blank 203 includes a mount assembly 310 foldably connected to the second side panel 231 along a longitudinal fold line 311. The front panel 223 has an oblique edge 312 extending between the fold lines 271, 311 and the back panel 237 has an oblique edge 314 extending between the fold lines 271, 311. When the blank 203 is erected into the carton 205 (FIG. 11), the mount assembly 310 forms an obliquely configured, upper corner of the carton to which a reclosable fitment 316 (FIGS. 12 and 13) can be mounted, such as by an adhesive, interference fit, and/or any other suitable connection. The mount assembly 310 has a central panel 318 and mounting flaps 320, 322, 324 that are respectively foldably connected to the central panel 318. The central panel 318 can include a dispenser panel 283 defined by (i.e., substantially circumscribed by) a tear line 285. The tear line 285 is shown as being substantially rectangular (e.g., in the form of a rectangle with rounded corners) in FIG. 8.

The dispenser panel 283 can include an access flap 326 for helping to initiate tearing of the tear line 285. The dispenser panel 283 can be alternatively shaped, arranged, positioned, and/or omitted without departing from the disclosure.

Figure 9:
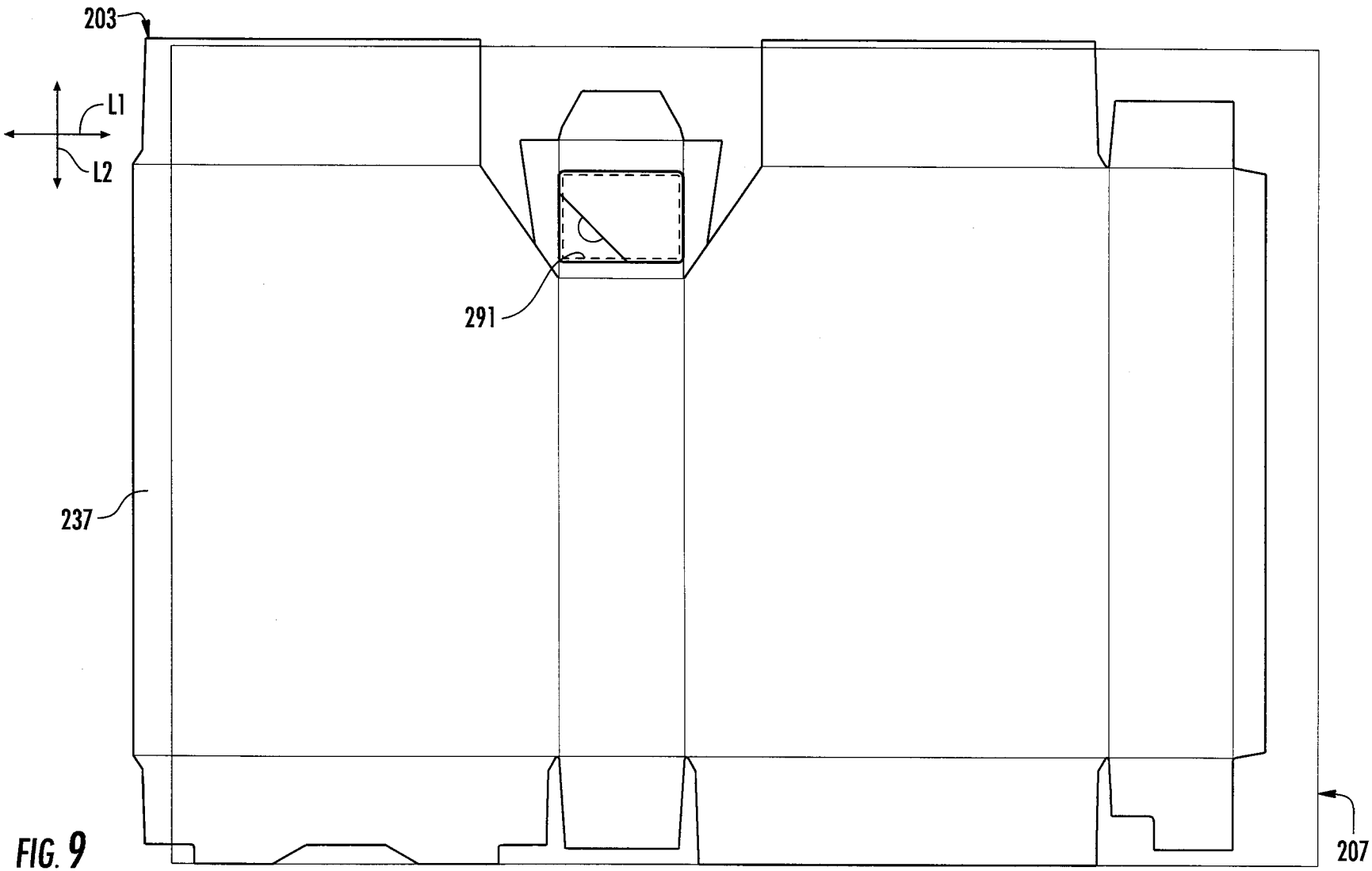
FIG. 9 is like of FIG. 8, except for showing a liner attached to the surface of the blank, in accordance with the second embodiment.
Figure 10:
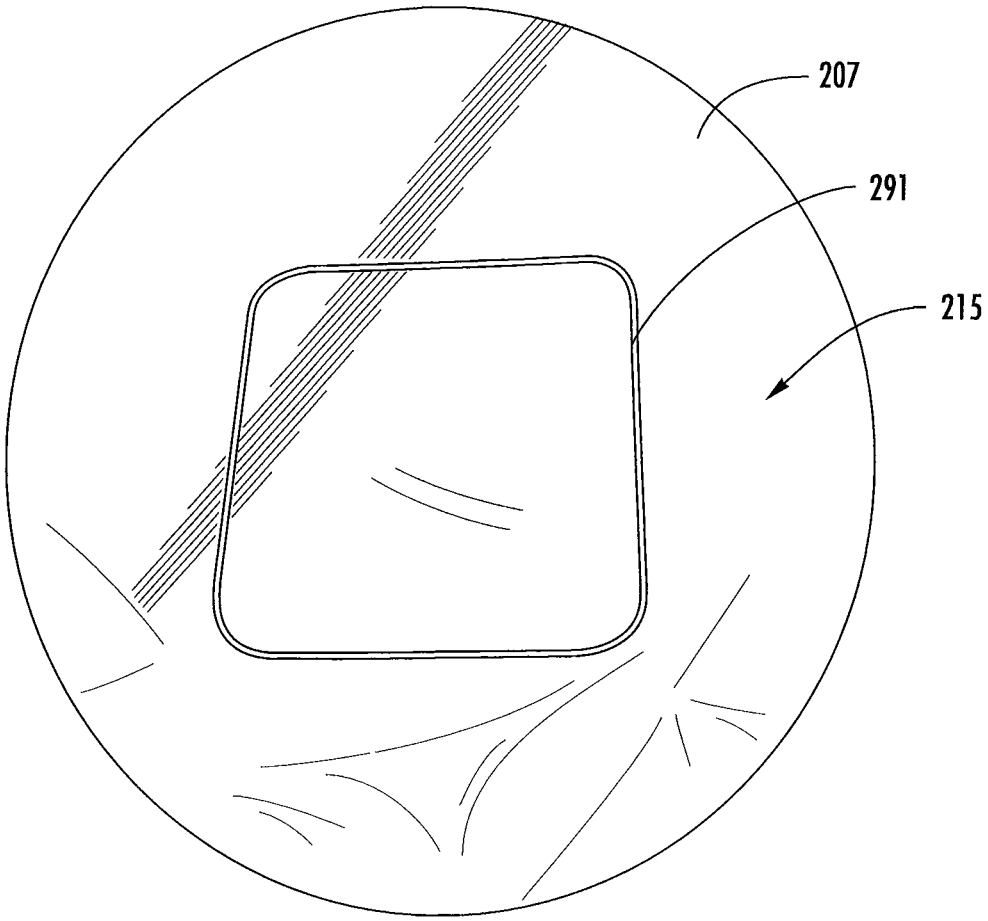
FIG. 10 is a pictorial view of a portion of the liner in accordance with the second embodiment.

As shown in FIGS. 9 and 10, the liner 207 can include a liner tear line 291 or other area of weakening that can be generally aligned with the dispenser panel 283 (FIG. 8). As shown in FIG. 9, the liner tear line 291 circumscribes (i.e., substantially circumscribes) a portion of the liner 207 that is superposed with the dispenser panel 283. In FIGS. 9 and 10, the tear line 285 is shown as being substantially rectangular (e.g., in the form of a rectangle with rounded corners).

Similarly to the liner 91 of the first embodiment, as shown schematically in FIG. 3, the liner tear line 291 may be in the form of kiss cut(s) and/or a series of perforations (e.g., micro-perforations) that typically do not extend through the entire thickness of the liner 207, so that the line of weakening does not (e.g., substantially does not) define open vent passageways that extend through the entire thickness of the liner 207. For example, the liner 207 can include multiple plies of material (e.g., at least one paper layer and at least one polymer layer) and the perforations can be in one layer and not another. The liner tear line 291 may be formed by laser scoring, die cutting, heat stamping, or any other suitable method.

A pressure control feature 215 with a similar structure as the pressure control feature 15 of the first embodiment shown in FIG. 3 can be incorporated into the liner tear line 291. Particularly, the pressure control feature 215 can include one or more apertures that are aligned with the tear line 291 to form one or more vent passageways that extend entirely through the liner 207. Accordingly, when the carton 205 is erected and the liner 207 is sealed around the interior 211 of the carton, air in the interior 211 can escape the liner 207 when the air pressure outside the carton 205 is lower than the pressure in the interior 211. The liner 207 and pressure control feature 215 of the second embodiment may be like the liner 7 and pressure control feature 15 of the first embodiment such that FIG. 3 is also illustrative of a cross section along the tear line 291 of the liner 207.

The carton 205 could be otherwise shaped, arranged, and/or configured without departing from the disclosure. For example, the pressure control features 15, 215 of the first and second embodiments can be used in conjunction with any carton having a liner, such as, but not limited to, a liner with a weakened area (e.g., tear line).

Figure 14:
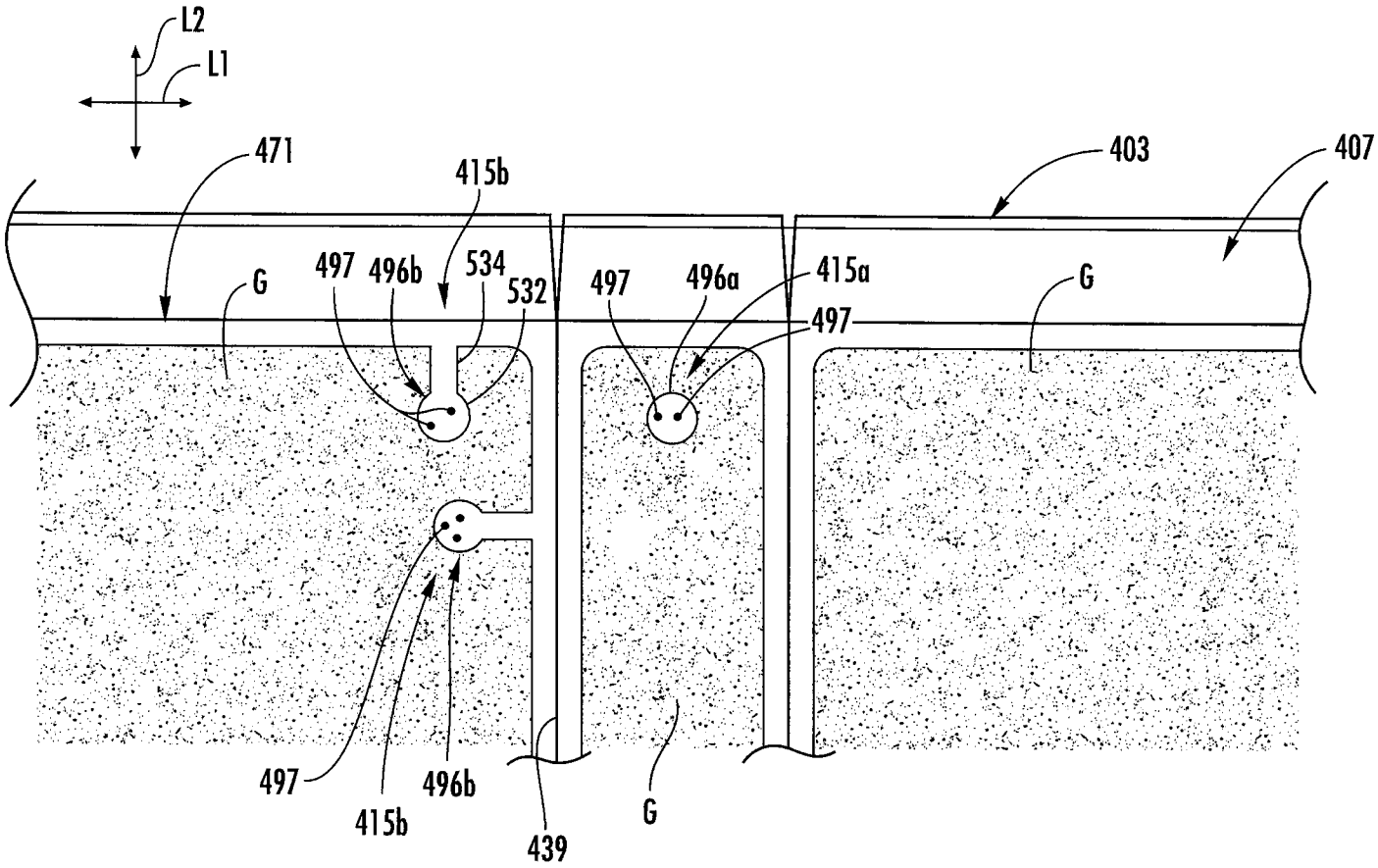
FIGS. 14 and 15 are schematic plan views of an erected carton blank and liner used to form a carton in accordance with a third embodiment of this disclosure.

FIG. 14 is a schematic plan view of a portion of a carton blank 403 having an alternative configuration, according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. The blank 403 includes several pressure control features 415*a*, 415*b* formed in the liner 407, which is shown in FIG. 14 as being a transparent liner for clarity. Alternatively, the liner can have any level of transparency or translucency, or the liner can be opaque. The different pressure control features 415*a*, 415*b* are included to illustrate variations of the pressure control features. The pressure control features 415*a*, 415*b* can be used individually, or in combination. The liner 407 can be adhered to the blank similarly to the liner 7 of the first embodiment. Accordingly, the stippled regions G in FIG. 14 schematically illustrate adhesive material and the regions of the liner that are glued (e.g., adhered with adhesive material) to the blank 403 according to the third embodiment. The shape and position of the regions G are shown by way of example. The regions G can be alternatively shaped, arranged, positioned, and/or omitted without departing from the disclosure.

As shown in FIG. 14, the first pressure control feature 415*a* can be located anywhere in any of the regions G and can include a vent chamber or void pattern 496*a* and one or more venting apertures 497 (e.g., micro perforations or any other suitable vent passageways for venting). The void pattern 496*a* can be a portion of one of the regions G that is substantially completely void of glue attaching the liner 407 to the blank 403. In the illustrated embodiment, the void pattern 496*a* is generally round. In one particular embodiment, the void pattern 496*a* can be approximately 0.5 inch in diameter, or otherwise sized so that each of the apertures 497 (e.g., vent passageways) aligned in the void pattern 496*a* is spaced apart from the edges of the void pattern approximately 0.125 inch, so that the apertures 497 are not obstructed by the adhesive material. Such a spacing can help account for variations in the alignment of the liner 407 when it is applied to the blank 403. Alternatively, the void pattern 496*a* can have any suitable shape and any suitable size without departing from the disclosure. In one aspect of this disclosure, the adhesive material that forms the adhered regions G does not obstructing the apertures 497 (e.g., vent passageways).

In the illustrated embodiment, the apertures 497 extend completely through the cross-section of the liner 407 so that air in the interior of a carton (not shown) formed from the blank 403 can escape the liner if the air pressure outside the liner is suitably reduced below the pressure inside the liner. The apertures 497 can be formed by a software-driven laser cutting system, for example. Alternatively, the apertures 497 can be formed by mechanical or other suitable means. In the illustrated embodiment, the apertures 497 can be in the range of about 0.003 inch to about 0.015 inch in diameter. That is, the apertures 497 may be less than about 0.015 inch in diameter. For example, in one exemplary embodiment the apertures 497 can each be approximately 0.004 inch in diameter. As shown in FIG. 14, the pressure control feature 415*a* can include two apertures 497 aligned with the void pattern 496*a*. Alternatively, the apertures 497 can be any suitable size, and the pressure control feature 415 can include any suitable number of apertures 497, and any suitable number of void patterns 496*a*, to allow air in the interior of the carton formed from the blank 403 to escape the liner 407 when the pressure in the liner is greater than the ambient pressure outside the carton to thereby help reduce stress on the liner 407. For example, a particularly large carton could include three or four apertures 497 as needed, or the two apertures 497 could be larger in diameter (e.g., approximately 0.008 inch). Each of the diameters may be perpendicular to the thickness of the liner 407.

Figure 15:
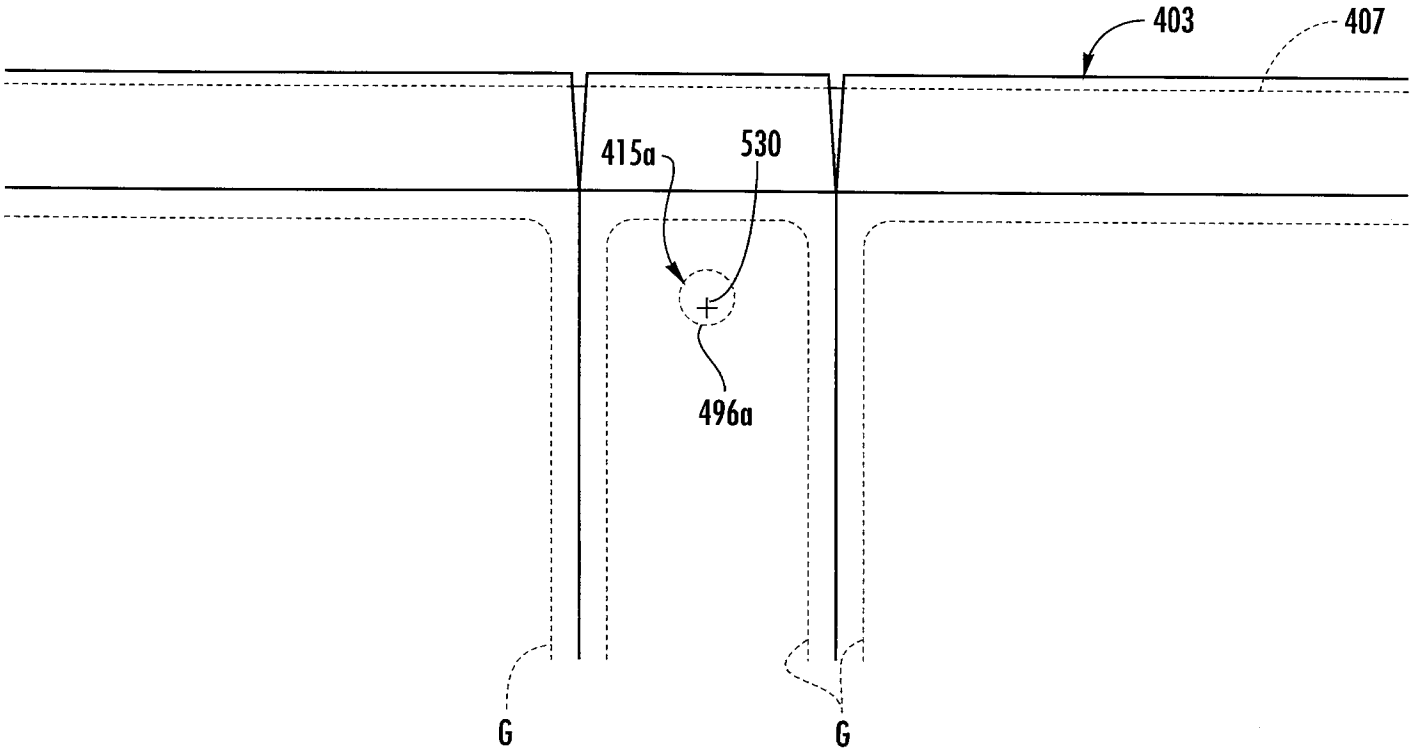

In the illustrated embodiment, the void pattern 496*a* (e.g., vent chamber) is entirely within the region G so that portions of the liner 407 that are glued to the blank 403 surround the void pattern 496*a*. Accordingly, any air escaping the sealed liner 407 in the erected carton due to a pressure differential can enter the vent chamber space between the liner and the outer carton formed by the blank 403. This may be sufficient to reduce stress on the liner 407 and its seals to help reduce deformation of the liner or failure of the seals. However, for a blank 403 comprising paperboard, air may also continue to vent through (e.g., between) the fibers of the paperboard to the ambient atmosphere so that additional air can escape the liner 407. As shown in FIG. 15, if the paperboard of the blank 403 comprises a gas-impermeable (or nearly gas-impermeable) coating, if the blank 403 comprises a nonporous, nonfibrous material, or if the venting rate is insufficient for helping to prevent failure of the liner 407, one or more holes that may be in the form of die cut slits 530, or other suitable cuts or holes, can be included and extend completely through in the blank 403 (e.g., in the form of a cross). The die cut slits 530 can be generally aligned with the void pattern 496*a* so that air in the void pattern between the liner and the blank 403 can escape through the die cut slits. In the illustrated embodiment, the die cut slits 530 are offset from the apertures 497. Alternatively, the die cut slits 530 can be generally aligned with the apertures 497. Further, the die cut slits 530 or other suitable venting holes in the blank 403 can be alternatively shaped, arranged, positioned, and/or omitted without departing from the disclosure.

In the illustrated embodiment, the void pattern 496*a* is located within the region G with glued portions of the liner 407 surrounding (circumscribing) the void pattern so that air can vent at a low rate through the paperboard of the outer carton formed from the blank 403 while helping to reduce the risk of unwanted elements (e.g., small organisms) from entering the interior of the carton. The pressure control feature 415 can be alternatively shaped, arranged, positioned, and/or omitted without departing from the disclosure.

As shown in FIG. 14, each of the pressure control features 415*b* includes a void pattern 496*b* and one or more of the apertures 497. The void patterns 496*b* each include a first portion 532 (e.g., vent chamber) positioned within the region G and a second portion 534 (e.g., vent pathway) communicating between the first portion and an edge of the region G. Accordingly, air can escape the liner 407 into the first portion 532 (e.g., vent chamber) through the apertures 497 and pass through the vent channel or passageway formed by the second portion 534 to expand into the unglued portions of the carton between the liner 407 and outer carton formed from the blank 403 outside the region G where the liner is adhered to the blank. The air can then pass through gaps between the overlapped portions of the outer carton formed from the blank 403, vent through any suitable tear or cut lines (e.g. slits) in the blank and/or vent through the blank material.

As shown in FIG. 14, the void pattern 496*b* can be oriented so that the outlet of the second portion 534 of the void pattern 496*b* is adjacent a longitudinal fold line 471, which is, for example, at the top of the outer carton formed from the blank 403, or a lateral fold line 439 connecting two panels of the blank. For the embodiment shown in FIG. 14 and for each of the void patterns 496*b*, the adhesive material of the associated region G together with the liner 407 and the blank 403 defines the a vent chamber (e.g., the first portion 532 of the void pattern 496*b*) and a vent passageway (e.g., the second portion 534 of the void pattern 496*b*) that is open to the vent chamber and extends to proximate the respective fold line 439, 471. Alternatively, an outlet end of the second portion 534 can discharge to any area outside the region G. The void patterns 496*b* can be alternatively shaped, arranged, positioned, and/or omitted without departing from the disclosure. For example, the second portion 534 could have any suitable width, could be curved, and/or could include one or more segments with multiple turns.

As shown in FIG. 14, the adhesive material positioned in the regions G for mounting the liner 407 to the blank 403 extends at least partially around the openings to the apertures 497, which may also be referred to as venting vent passageways. The adhesive material of the regions G circumscribes the apertures 497 of the pressure control features 415*a*, whereas the adhesive material of the regions G only extends partially around the apertures 497 of the pressure control features 415*b*.

Figure 16:
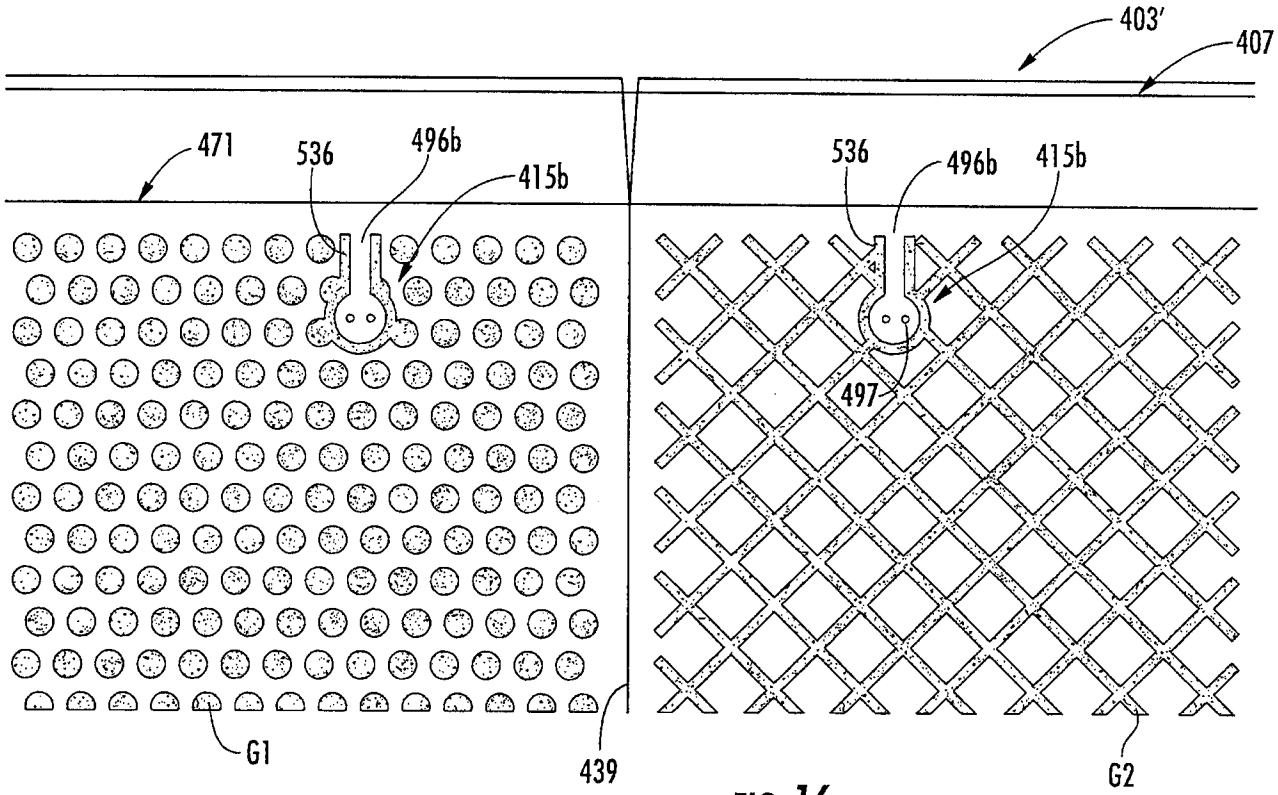
FIG. 16 is a schematic plan view of a variation of the carton blank and liner of the third embodiment, wherein the variation comprises modified glue patterns.

In the illustrated embodiments, the liners of the various embodiments can be glued to the respective blanks in any suitable manner for securing the liner to the blank. For example, the liner 407 can be secured to the blank 403 by coating the regions G substantially entirely with adhesive material (e.g., glue) except for within the void patterns 496*a*, 496*b*. Alternatively, as shown in FIG. 16, the liner 407 can be secured to the blank 403' by a glue pattern G1 and/or G2, or by any other suitable glue pattern. A pressure control feature 415*b* is included in the liner 407 among each of the glue patterns G1, G2. Alternatively, or in addition, one or more pressure control features 415*a* could be included in the liner 407 among one or both of the glue patterns G1, G2. The glue pattern G1 is a series of dots of glue, which dots can be any suitable size or shape for securing the liner 407 to the blank 403'. Further, the dots can be aligned, or partially aligned, in a grid, or randomly applied. The glue pattern G2 can be a cross-hatched pattern of lines of any suitable size for securing the liner 407 to the blank 403'. In each of the glue patters G1, G2, each of the void patterns 496*b* of the pressure control features 415*b* are bordered by a glue line 536 that defines the void patterns 496*b* within the glue patterns G1, G2. In an alternative embodiment, the glue lines 536 can be omitted. The glue patterns G1, G2 are included by way of example. Alternatively, any suitable glue pattern can be used to secure the liner to the blank. The embodiment(s) of FIG. 16 may be like the previously discussed embodiments, except for variations noted and variations that will be apparent to one of ordinary skill in the art.

Any of the features of the various embodiments of this disclosure can be combined with, replaced by, or otherwise configured with other features of other embodiments of this disclosure without departing from the scope of this disclosure. Further, it is noted that the pressure control features of the various embodiments can be incorporated into a carton having any carton style, liner configuration, or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits (e.g., a series of perforations) that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more features adhered together by glue. The term "glue" is intended to encompass all manner of adhesives commonly used to secure carton panels and/or seal liners.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure. It will be understood by those skilled in the art that while the present disclosure has been discussed above with reference to exemplary embodiments, various additions, modifications and changes can be made thereto without departing from the spirit and scope of the inventions as set forth in the claims.

What is claimed is:

1. A package for containing and dispensing contents, the package comprising:

a carton; and a liner positioned in an interior of the carton, the liner comprising at least one vent passageway extending through the liner, the vent passageway being configured for automatically in a predetermined manner relieving gas pressure from within an area enclosed by the liner; wherein the liner is a laminate comprising an inner ply and outer ply;

the vent passageway includes both a hole in the inner ply and a hole in the outer ply, and the holes are in fluid communication with one another; and one of the holes is smaller than the other of the holes, for restricting flow through the vent passageway.

2. The package according to claim 1, wherein at least a portion of the vent passageway has a diameter of less than about 0.015 inches.

3. The package according to claim 1, wherein at least a portion of the vent passageway has a diameter in a range of about 0.003 inches to about 0.015 inches.

4. The package according to claim 1, wherein the liner is mounted to the carton and forms a substantially closed inner container that is positioned in an interior of the carton, and the vent passageway extends through a wall of the container.

5. The package according to claim 1, wherein:

the hole in the outer ply is one of a series of holes that at least partially define a tear line in the outer ply; and the hole in the inner ply is smaller than the hole in the outer ply.

6. The package according to claim 5, wherein:

the outer ply comprises paper; and the inner ply comprises polymer film.

7. The package according to claim 5, wherein:

the hole in the inner ply is one of a series of holes in the inner ply; and spacing between adjacent holes of the series of holes in the inner ply is greater than spacing between adjacent holes of the series of holes in the outer ply.

8. A package for containing and dispensing contents, the package comprising:

a carton;

a liner positioned in an interior of the carton, the liner comprising at least one vent passageway extending through the liner, the vent passageway being configured for automatically in a predetermined manner relieving gas pressure from within an area enclosed by the liner; and adhesive material, the liner being mounted to a panel of the carton at least by way of the adhesive material, and the adhesive material not obstructing the vent passageway.

9. The package according to claim 8, wherein the adhesive material extends at least partially around an opening to the vent passageway.

10. The package according to claim 9, wherein the adhesive material circumscribes the opening to the vent passageway.

11. The package according to claim 9, wherein the opening of the vent passageway is open to a vent chamber cooperatively defined by the panel, liner and adhesive material.

12. The package according to claim 11, wherein the panel comprises a hole that is open to the vent chamber.

13. The package according to claim 11, wherein the panel, liner and adhesive material cooperatively define a second vent passageway that is open to the vent chamber.

14. The package according to claim 13, wherein an open end of the second vent passageway is proximate a fold line foldably connecting the panel to another panel.

15. A package for containing and dispensing contents, the package comprising:

a carton;

a liner positioned in an interior of the carton, the liner comprising pressure control means for automatically in a predetermined manner relieving gas pressure from within an area enclosed by the liner; and adhesive material, the liner being mounted to a panel of the carton at least by way of the adhesive material, and the adhesive material not obstructing the pressure control means.

16. The package according to claim 15, wherein:

the carton comprises a plurality of panels respectively foldably connected to one another, and the plurality of panels extends around an interior of the carton.

17. The package according to claim 16, wherein:

the pressure control means comprises at least one vent passageway extending through the liner, and the adhesive material not obstructing the vent passageway.

18. The package according to claim 17, wherein at least a portion of the vent passageway has a diameter in a range of about 0.003 inches to about 0.015 inches.

19. The package according to claim 17, wherein the adhesive material extends at least partially around an opening to the vent passageway.

20. The package according to claim 19, wherein the adhesive material circumscribes the opening to the vent passageway.

21. The package according to claim 19, wherein the opening of the vent passageway is open to a vent chamber cooperatively defined by the panel, liner and adhesive material.

22. The package according to claim 21, wherein the panel comprises a hole that is open to the vent chamber.

23. The package according to claim 21, wherein the panel, liner and adhesive material cooperatively define a second vent passageway that is open to the vent chamber.

24. The package according to claim 23, wherein an open end of the second vent passageway is proximate a fold line foldably connecting the panel to another panel of the plurality of panels.

25. The package according to claim 15, wherein the pressure control means comprises at least one vent passageway extending through the liner.

26. The package according to claim 25, wherein at least a portion of the vent passageway has a diameter in a range of about 0.003 inches to about 0.015 inches.

27. The package according to claim 25, wherein the liner is mounted to the carton and forms a substantially closed inner container that is positioned in the interior of the carton, and the vent passageway extends through a wall of the container.

28. A package for containing and dispensing contents, the package comprising:

a carton; and a liner positioned in an interior of the carton, the liner comprising pressure control means for automatically in a predetermined manner relieving gas pressure from within an area enclosed by the liner, wherein:

the liner is a laminate comprising an inner ply and outer ply;

the pressure control means includes both a hole in the inner ply and a hole in the outer ply, and the holes are configured so that the holes are in fluid communication with one another; and one of the holes is smaller than the other of the holes, for restricting flow through the vent passageway.

29. The package according to claim 28, wherein:

the hole in the outer ply is one of a series of holes that at least partially define a tear line in the outer ply; and the hole in the inner ply is smaller than the hole in the outer ply.

30. The package according to claim 29, wherein:

the outer ply comprises paper; and the inner ply comprises polymer film.

31. The package according to claim 29, wherein:

the hole in the inner ply is one of a series of holes in the inner ply, and the series of holes in the inner ply partially defines the pressure control means; and spacing between adjacent holes of the series of holes in the inner ply is greater than spacing between adjacent holes of the series of holes in the outer ply.

32. A carton blank for being formed into a package, the carton blank comprising:

a plurality of panels respectively foldably connected to one another; and a liner mounted to at least one panel of the plurality of panels, the liner comprising at least one vent passageway extending through the liner, the vent passageway being configured for automatically in a predetermined manner relieving gas pressure from within an area enclosed by the liner when the carton blank is formed into the package.

33. The carton blank according to claim 32, wherein at least a portion of the vent passageway has a diameter of less than about 0.015 inches.

34. The carton blank according to claim 32, wherein at least a portion of the vent passageway has a diameter in a range of about 0.003 inches to about 0.015 inches.

35. The carton blank according to claim 32, wherein:

the liner is a laminate comprising an inner ply and outer ply;

the vent passageway includes both a hole in the inner ply and a hole in the outer ply, and the holes are aligned so that the holes are in fluid communication with one another; and one of the holes is smaller than the other of the holes, for restricting flow through the vent passageway.

36. The carton blank according to claim 35, wherein:

the outer ply comprises paper; and the inner ply comprises polymer film.

37. The carton blank according to claim 35, wherein:

the hole in the outer ply is one of a series of holes that at least partially define a tear line in the outer ply; and the hole in the inner ply is smaller than the hole in the outer ply.

38. The carton blank according to claim 37, wherein:

the hole in the inner ply is one of a series of holes in the inner ply; and spacing between adjacent holes of the series of holes in the inner ply being greater than spacing between adjacent holes of the series of holes in the outer ply.

39. The carton blank according to claim 32, comprising adhesive material, the liner being mounted to a panel of the plurality of panels at least by way of the adhesive material, and the adhesive material not obstructing the vent passageway.

40. The carton blank according to claim 39, wherein the adhesive material extends at least partially around an opening to the vent passageway.

41. The carton blank according to claim 40, wherein the adhesive material circumscribes the opening to the vent passageway.

42. The carton blank according to claim 40, wherein the opening of the vent passageway is open to a vent chamber cooperatively defined by the panel, liner and adhesive material.

43. The carton blank according to claim 42, wherein the panel comprises a hole that is open to the vent chamber.

44. The carton blank according to claim 42, wherein the panel, liner and adhesive material cooperatively define a second vent passageway that is open to the vent chamber.

45. The carton blank according to claim 44, wherein an open end of the second vent passageway is proximate a fold line foldably connecting the panel to another panel of the plurality of panels.

46. A method of forming a package, the method comprising:

erecting a carton with a liner, so that the liner forms a substantially closed inner container that is positioned in an interior of the carton; and the liner comprising at least one vent passageway extending through the liner, the vent passageway being configured for automatically in a predetermined manner relieving gas pressure from within substantially closed inner; wherein the liner is a laminate comprising an inner ply and outer ply;

the vent passageway includes both a hole in the inner ply and a hole in the outer ply, and the holes are in fluid communication with one another; and one of the holes is smaller than the other of the holes for restricting flow through the vent passageway.

47. The method according to claim 46, comprising using adhesive material in the forming of the package, and positioning the adhesive material so that the vent passageway is not obstructed by the adhesive material.

48. A method of forming a package, the method comprising:

obtaining a carton blank comprising a plurality of panels respectively foldably connected to one another;

mounting a liner to at least one panel of the plurality of panels, the liner comprising at least one vent passageway extending through the liner;

erecting the carton with the liner positioned at least partially in an interior of the carton; and enclosing an area with the liner, the vent passageway being configured for automatically in a predetermined manner relieving gas pressure from within the area enclosed by the liner.

* * * * *